United States Patent [19]

McClure

[11] Patent Number: 4,676,428

[45] Date of Patent: Jun. 30, 1987

[54] FOLD LINE RELIEF CUTS FOR PAPERBOARD CONTAINERS AND METHOD OF FABRICATION

[75] Inventor: Jack A. McClure, Garden City, Kans.

[73] Assignee: Inland Container Corporation, Indianapolis, Ind.

[21] Appl. No.: 843,767

[22] Filed: Mar. 25, 1986

Related U.S. Application Data

[63] Continuation-in-part of Ser. No. 750,412, Jun. 28, 1985, Pat. No. 4,621,766.

[51] Int. Cl.[4] ..... B65D 5/42

[52] U.S. Cl. ..... 229/16 R; 229/DIG. 4; 229/920; 428/155; 493/59; 493/162; 493/356

[58] Field of Search ..... 229/DIG. 4, 920, 6 R, 229/16 R; 428/130, 155; 493/59-61, 356, 162

[56] References Cited

U.S. PATENT DOCUMENTS

| | | | |
|---|---|---|---|
| 1,206,839 | 12/1916 | Gruenberg | 229/920 |
| 1,771,760 | 7/1930 | MacLlellan | 229/DIG. 4 |
| 2,157,686 | 5/1939 | Ballard | 229/DIG. 4 |
| 3,228,710 | 1/1966 | Chodorowski | 493/356 |
| 3,469,762 | 9/1969 | Torre | 229/920 |
| 3,698,548 | 10/1972 | Stenzel et al. | 229/920 |
| 4,210,241 | 7/1980 | Morcom | 229/DIG. 4 |

*Primary Examiner*—William Price
*Assistant Examiner*—Gary E. Elkins
*Attorney, Agent, or Firm*—Fitch, Even, Tabin & Flannery

[57] ABSTRACT

A one-piece corrugated fiberboard blank and the triple-end container assembled therefrom wherein the blank includes a rectangular bottom panel with a side panel hingedly attached to each of the two opposite sides thereof. Hingedly attached to the remaining two opposite sides of the bottom panel are first, exterior end panels, each having a hand-hold slot formed therein. Second, intermediate end panels sized in width to extend approximately half way across the first end panel in the assembled container are hingedly attached to the opposite ends of each side panel. Each intermediate end panel has a cutout complementary to the hand-hold slot in the first end panel and includes an extension hingedly attached thereto that folds back upon the intermediate end panel to form the third, innermost end panel. The extension includes a plurality of fold lines in its outer portion adjacent the common hinge between each second end panel and its respective extension, with none of the fold lines being collinear with the hinge. Accordingly, when the extension is folded back upon the second end panel, portions of extension defined by the fold lines bow-out to form an enclosure behind the hand-hold slot in the second end panel. Upon final assembly of the container, the second end panels and their extension are folded so that both enclosures at each end of the blank defined by the divergent fold lines register with the hand-hold slots of the first end panel to substantially seal the hand-holds. To ensure that the panels fold square along their fold lines, the fold lines have transverse relief cuts at the opposite ends thereof.

8 Claims, 13 Drawing Figures

29
44
32
24
30
26
28
20
12
19
16
18
14
15
11
46
45
50
48

FOLD LINE RELIEF CUTS FOR PAPERBOARD CONTAINERS AND METHOD OF FABRICATION

This application is a continuation-in-part of my copending application, Ser. No. 750,412, filed June 28, 1985, now U.S. Pat. No. 4,621,766, issued Nov. 11, 1986.

The present invention relates to a method for converting a blank for a triple-end container and, more particularly, to a fold line configuration that ensures accurate and square folding of the container upon assembly of the blank.

BACKGROUND OF THE INVENTION

For packaging heavy items, triple-end boxes, that is, boxes having three thicknesses of fiberboard at the end panels, have met with general acceptance. Such boxes have proven stronger and more durable than previously used boxes, and, because of the increased strength in the vertical direction, have permitted stacking of the boxes. Additionally, the hand-holds, which are areas of high stress, have typically been located in the end panels. Because of the triple thickness of the end panels, problems with failure of the hand-holds by, e.g., tearing have been greatly reduced.

When packaging foodstuffs, particularly cuts of meat, in boxes such as those described above, it is desirable that the box be secure from both airborne contamination and human contact with the contents of the box as might occur during the handling thereof. Such contaminating contact is most likely to occur through the cutouts that form the hand-holds. To prevent contamination by access to the contents of the container through the hand-holds, boxes have been constructed so that a closed vacancy or enclosure is formed behind or interior of the hand-hold. While presently known designs have performed satisfactorily in preventing contamination of the contents of the containers, the vacancies behind the hand-holds have not been sufficiently deep to permit a person to gain an adequate grip through the hand-hold. Further, the enclosures have extended across the entire width of the end panel, thus taking up needed space on the interior of the container. Additionally, in known designs the formation of the hand-hold enclosure has required additional folding and assembly steps, thereby increasing the cost of such containers. Also, problems have arisen during the conversion of blanks for such boxes into the assembled container with having the various panels of the blank accurately fold along the desired lines.

SUMMARY OF THE INVENTION

Accordingly, it is the primary object of the present invention to provide an improved triple-end box and blank therefor that maintains the integrity of the contents therein by inhibiting the entry of contaminants into the assembled box. More particularly, it is an object to provide such a box having improved hand-hold enclosures.

Another object is to provide a blank that is easily assembled into a box and in which the enclosed hand-holds are self-forming, require no additional assembly steps, and extend only in the immediate area of the hand-hold slots.

A further object is to provide a blank for a triple-end box that folds accurately along the desired lines during automated conversion of the blank into a container.

These objects are satisfied by a one-piece corrugated fiberboard blank and the triple-end container assembled therefrom wherein the blank includes a rectangular bottom panel with a side panel hingedly attached to each of the two opposite sides thereof. Hingedly attached to the remaining two opposite sides of the bottom panel are first, exterior end panels, each having a hand-hold slot formed therein. Second, intermediate end panels sized in width to extend approximately half way across the first end panel in the assembled container are hingedly attached to the opposite ends of each side panel. Each intermediate end panel has a cutout complementary to the hand-hold slot in the first end panel and includes an extension hingedly attached thereto that folds back upon the intermediate end panel to form the third, innermost end panel. The extension includes a plurality of fold lines in its outer portion adjacent the common hinge between each second end panel and its respective extension, with none of the fold lines being collinear with the hinge. Accordingly, when the extension is folded back upon the second end panel, portions of extension defined by the fold lines bow-out to form an enclosure behind the hand-hold slot in the second end panel. Upon final assembly of the container, the second end panels and their extension are folded so that both enclosures at each end of the blank defined by the divergent fold lines register with the hand-hold slots of the first end panel to substantially seal the hand-holds. To ensure that the panels fold squarely with respect to their fold lines, the fold lines have transverse relief cuts at the opposite ends therof.

Other features and advantages of the invention will become apparent upon reference to the accompanying drawings and the detailed description which follows.

DETAILED DESCRIPTION OF THE PREFERRED EMBODIMENT

Figure 1:
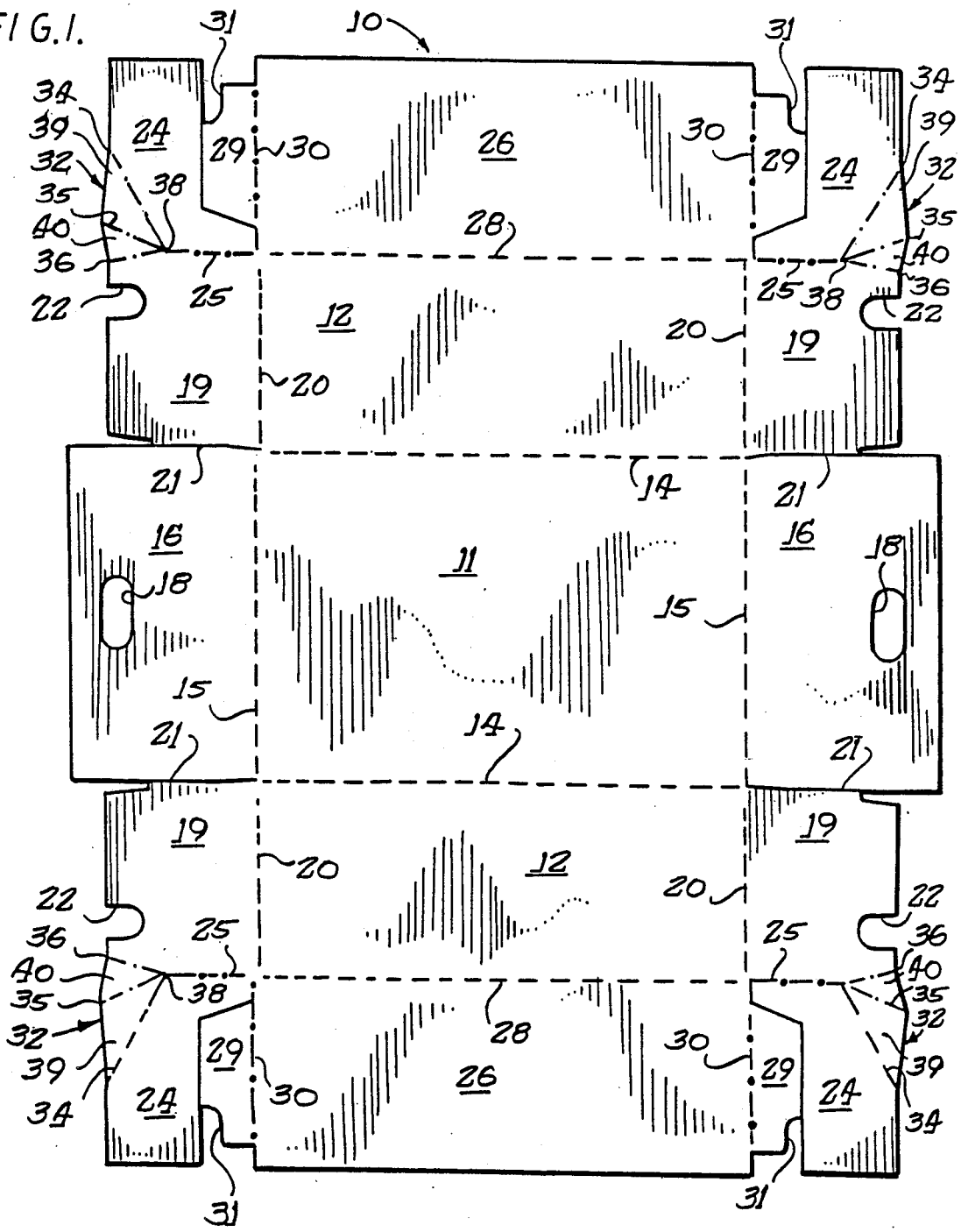
FIG. 1 is a plan view of a blank that may be assembled into the inventive container.

Referring now to the figures of the drawings, first the inventive blank will be described and then the assembly of the blank into a container. A one-piece blank generally indicated by 10 is shown in FIG. 1 and is formed and cut out by conventional methods. (In FIG. 1, solid lines between adjacent panels indicate that the lines are cut clean through; dash lines indicate crease or fold lines; and dash-dot lines indicate that the crease lines are either scored or relief cut.) The blank may be made from, for example, corrugated material having a bursting strength of approximately 275 pounds per square inch. Additionallv, the surfaces of the blank that form the interior of the container are preferably coated with a wax-like material to make it substantially moisture-resistant.

As is common with blanks for known triple-end containers, the blank 10 includes a substantially rectangular bottom panel 11, with side panels 12 hingedly attached along the opposite sides of the bottom panel by crease or fold lines 14. Preferably, the blank 10 is oriented so that the corrugations of the fiberboard run substantially widthwise between the side panels 12. Hingedly attached to the opposite ends of the bottom panel 11 by fold or crease lines 15 are outer or exterior end panels 16. Each end panel 16 includes a hand-hold slot 18 centered with respect to the width of the panel 16 and adjacent to the outer edge thereof. A slot 18 approximately 3½ inches long and 1¼ inches wide is sufficiently large to provide a grip for an average-sized hand.

Figure 5:
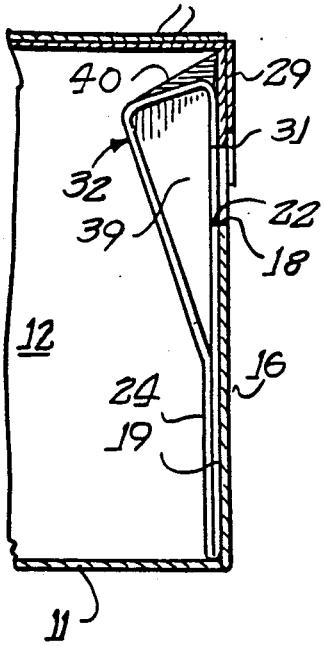
FIG. 5 is a vertical cross section taken substantially along line 5—5 of FIG. 3 showing the hand-hold enclosure construction.
Figures 8, 9, 10:
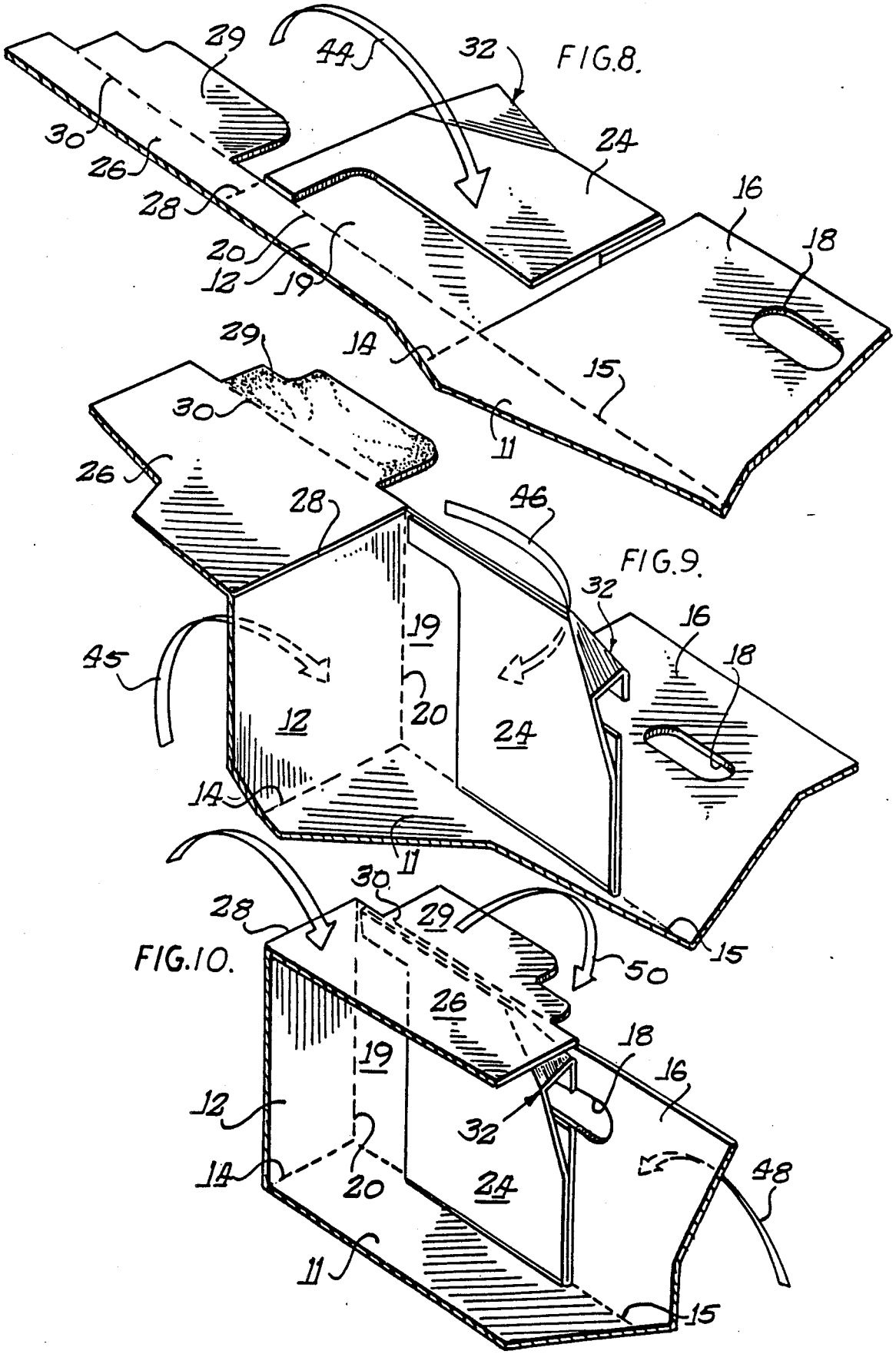

Intermediate end panels 19 are hingedly attached by crease lines 20 to the opposite ends of the side panels 12 and adjacent to, but separate from, the exterior end panels 16, as indicated by the solid lines 21 between the panels 19 and 16. The intermediate end panels 19 are sized in width so that when folded into the assembled container each panel 19 will extend approximately halfway across the exterior end panel 16. Further, each intermediate end panel 19 includes a cutout 22 which, when folded, registers with the hand-hold slot 18 in the exterior end panel 16, as best seen in FIGS. 5 and 10.

An extension 24 that forms the third, innermost end panel is hingedly attached by means of a scored fold line 25 to each of the intermediate end panels 19. When assembled, the extension 24 is folded back across the scored crease 25 and is adhesively secured to the intermediate end panel 19 (best seen in FIG. 8), which in turn is secured to the outer end panel 16 (as shown in FIGS. 9 and 10).

Figure 6:
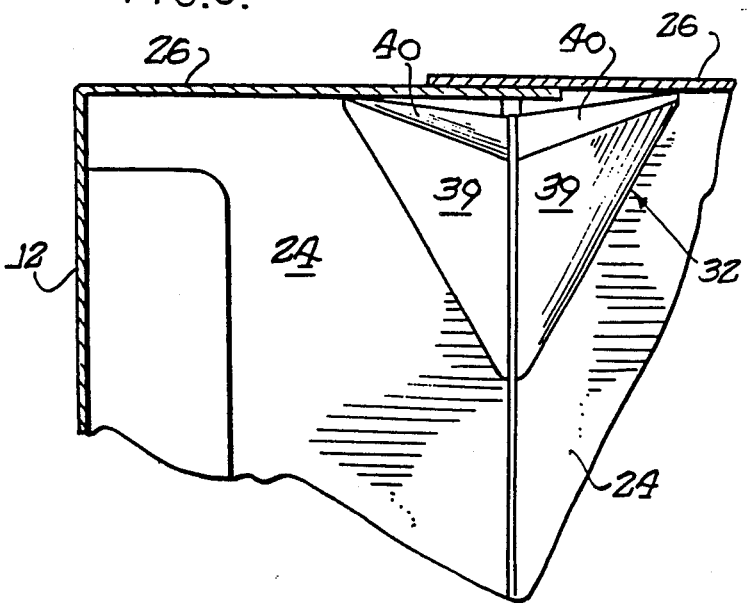
FIG. 6 is a fragmentary vertical cross section taken substantially along line 6—6 of FIG. 4 showing the hand-hold enclosure construction from the interior of the assembled container.

As thus far described, the blank 10 would form an open-topped box. The illustrated blank 10 further includes closure flaps 26 hingedly secured to the side panels 12 by means of crease lines 28. The closure flaps 26 are sized in width to overlap by approximately 2½ inches when folded (as best seen in FIG. 6), to provide a sealing area in which one flap 26 may be adhesively secured to the other. As illustrated, each closure flap 26 includes a glue flap 29 hingedly attached by a scored crease line 30 at the opposite ends thereof which facilitate securing the assembled container in its closed condition by gluing the flaps 29 to the exterior end panels 16 after the flaps 26 are closed (as indicated in FIG. 10). Each glue flap 29 is adjacent to but separate from the extensions 24 and each glue flap 29 includes a cutout 31 complementary to the hand-hold 18 in the exterior end panel 16 when glued thereto. Alternatively, a separate closure (not shown) for the open upper end may be used.

In keeping with the invention, the junction between the intermediate end panels and the extensions thereof are provided with self-forming enclosures that are created upon folding of the blank and which, upon assembly, align with the hand-hold slot in the exterior end panels to prevent ingress into the interior of the assembled container. Such self-forming enclosures require no additional folding or assembly steps than are required for a container without such enclosures, and the enclosures extend only in the immediate area of the hand-hold slots, thus utilizing less space on the interior of the container than presently known hand-hold enclosures.

Returning to FIG. 1, the blank 10 includes a hand-hold enclosing portion, generally indicated by 32, defined by divergent, scored crease lines 34–36, all having a common vertex 38 substantially on the crease line 25 between the intermediate end panel 19 and the extension 24. The crease lines 34–36 diverge in the direction of the outer edges of the panels 19, 24, and none of the divergent lines 34–36 is collinear with the scored fold line 25. When the extension 24 is folded about the hinge 25 to come into abutting contact with the intermediate end panel 19, the triangular portions 39, 40 defined by the crease lines 34–36 fold out into an open-faced, pyramid-like shape behind the cutout 22 (best seen in FIGS. 4–6 and 8–10).

Figure 3:
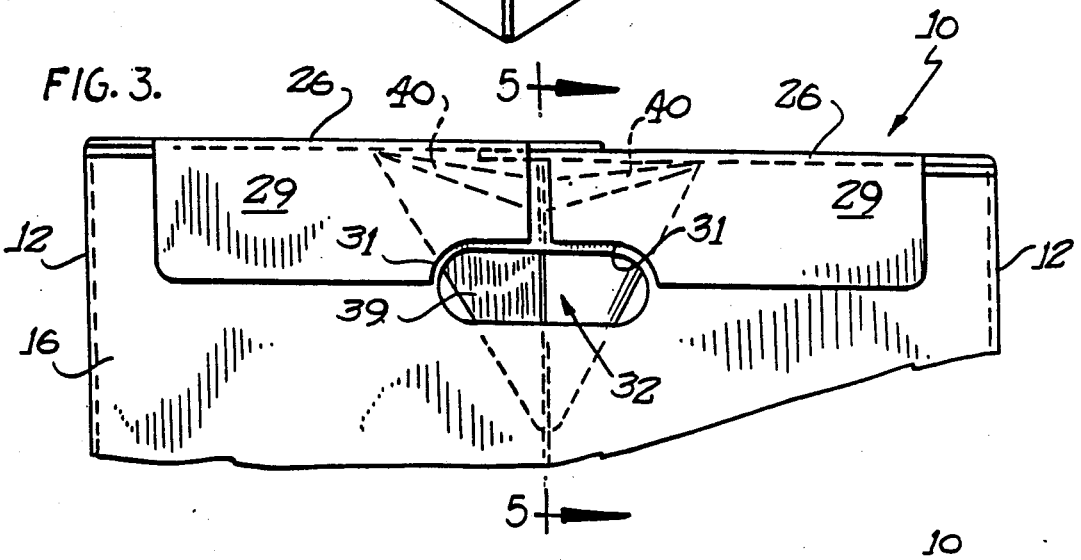
FIG. 3 is a fragmentary elevational view of the end panel of the assembled container showing the hand-hold enclosure construction.
Figure 4:
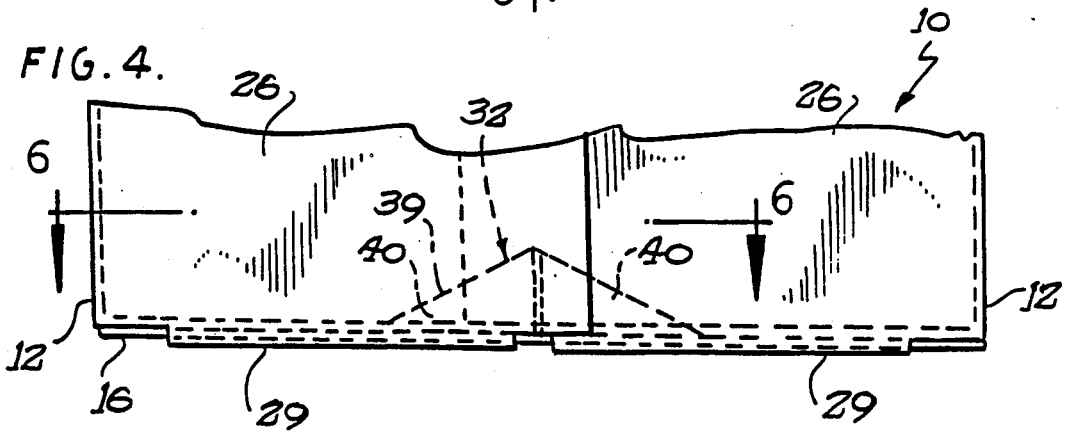
FIG. 4 is a fragmentary top view of the hand-hold end of the assembled container.

In the preferred embodiment, score lines 34, 35 form approximately a 40° angle with respect to each other, while an angle of approximately 35° is formed between fold lines 35, 36. The fold line 36 is disposed at an angle of approximately 15° with respect to a center line defined by the hinge line 25, with the score lines 34, 35 being on the opposite side of such a center line. In other words, score line 36 is disposed at an angle of approximately 15° with respect to a center line defined by the fold line 25, while score lines 34 and 35 form angles of 60° and 20° respectively, with respect to the center line defined by the fold line 25, but on the opposite side thereof. However, other angular combinations may be used so long as the score line 36 is on one side of the center line defined by the fold line 25, while the score lines 34, 35 are on the other side, with the score lines extending slightly further inward toward score line 30 than the cutout 22 is with respect to the fold line 20. This ensures that upon folding the extension 24 back upon the intermediate end panel 19 a pyramid-shaped vacancy will be formed over the hand-hold cutout 22 in the end panel 19 only in the immediate area of the cutout 22. When both end panels 19, 24 on one end of the blank 10 are folded into conjunction with the exterior end panel 16, the open faces of the enclosures 32 from the two opposite sides of the blank 10 meet to complete the enclosure 41 as seen in FIGS. 3, 4 and 6.

Figure 11:
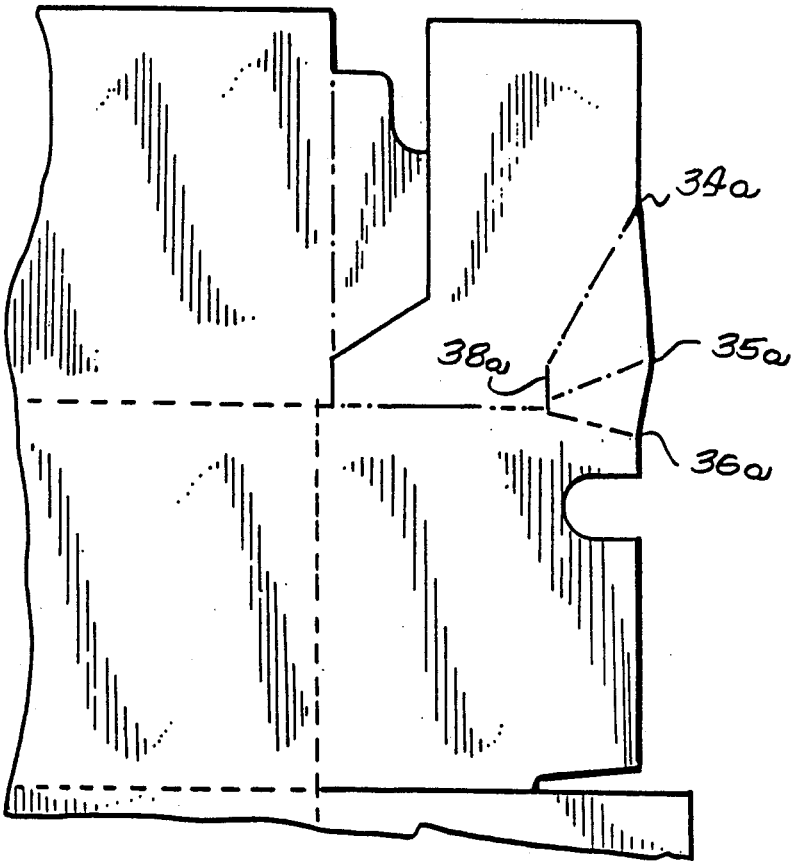
FIGS. 11 and 12 are fragmentary plan views of the hand-hold portion of alternative embodiments of the inventive blank.
Figure 12:
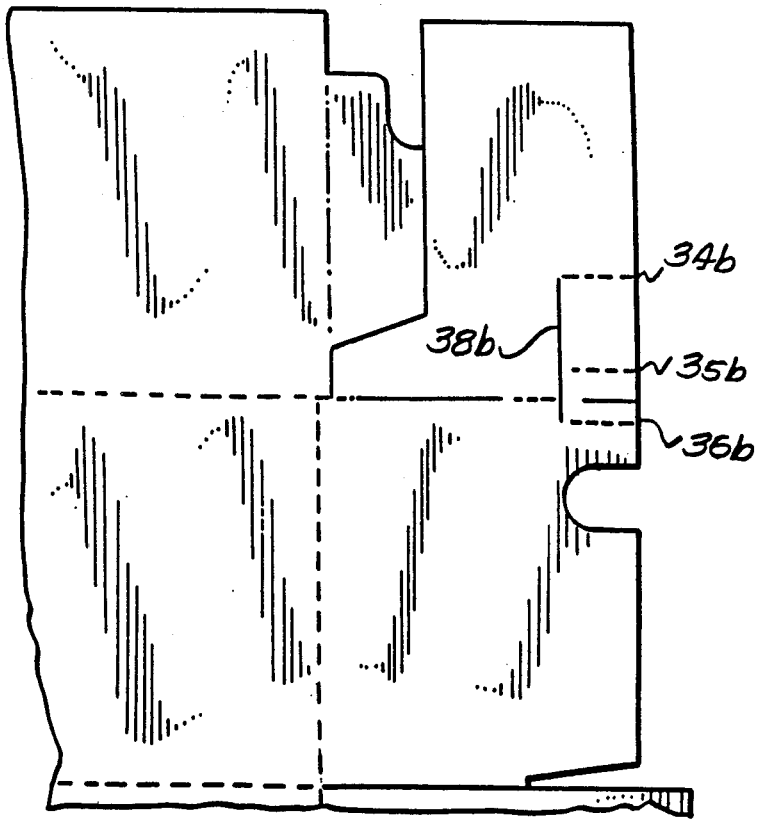

Alternatively, the vacancy-defining fold lines may be disposed as shown in FIGS. 11 and 12. With reference to FIG. 11, the fold lines **34*a*–36*a* diverge from a score line 38*a*. As illustrated in FIG. 12, the fold lines 34*b*–36*b* are parallel and have their inner ends joined by the score line 38*b*. As long as the fold line 36 is on the opposite side of the center line defined by the hinge line 25 from the fold lines 34, 35, a self-forming vacancy will be created behind the hand-hold cutout 22 upon folding the extension 24 back on the intermediate end panel 19**.

Assembly of the inventive blank 10 into a container having hand-hold enclosures is more clearly illustrated by referring to FIGS. 7–10. The figures show only half of one end of the blank, and it should be understood that the same steps that are described subsequently will be simultaneously performed on the other side of the blank, as well as the opposite end.

Figure 7:
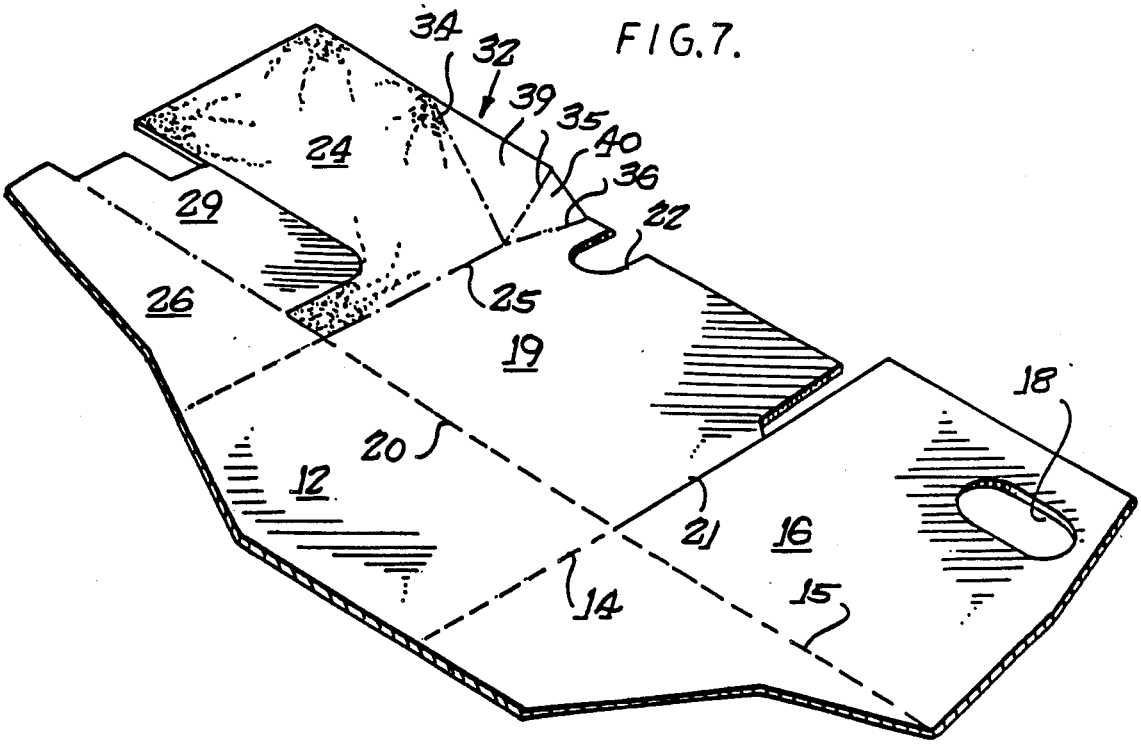
FIGS. 7–10 are fragmentary perspective views showing one-half of the hand-hold end of the blank, and showing the assembly thereof into the container.

Starting with the flat blank 10 as illustrated in FIG. 7, adhesive is applied to the extension 24, with care being taken not to apply adhesive to the triangular pieces 39, 40 that will form the hand-hold enclosure. Referring to FIG. 8, the extension 24 is folded about hinge line 25, as indicated by arrow 44, to come into face-to-face contact with the intermediate end panel 19, the two panels 19, 24 being secured to each other by means of the adhesive. Upon so folding, the triangular pieces 39, 40 fold to form an open-faced pyramid over the hand-hold cutout 22 in the intermediate end panel 19.

Because the length of the hinge line 25 is short when compared to the length of the extension 24, when the extension 24 is folded as indicated by arrow 44 in FIG. 8, it is often difficult to have the extension 24 fold entirely on the hinge line. Rather, the extension will start to fold on the hinge line 25, but will skew off the hinge line 25. This is particularly common during machine conversion of blanks in which the blanks travel on a conveyor system with the various flaps, panels and extensions being folded by, e.g., turn bars or plows. While the fold is initiated on the hinge line, the oblique force exerted on the flap by the turn bar causes the fold to skew from the hinge line. With the instant blank 10, the problem is further aggravated by the fold lines 34–36 for the handle enclosure being offset from the hinge line 25, which encourage the fold for the flap 24 to skew toward such fold lines.

Figure 13:
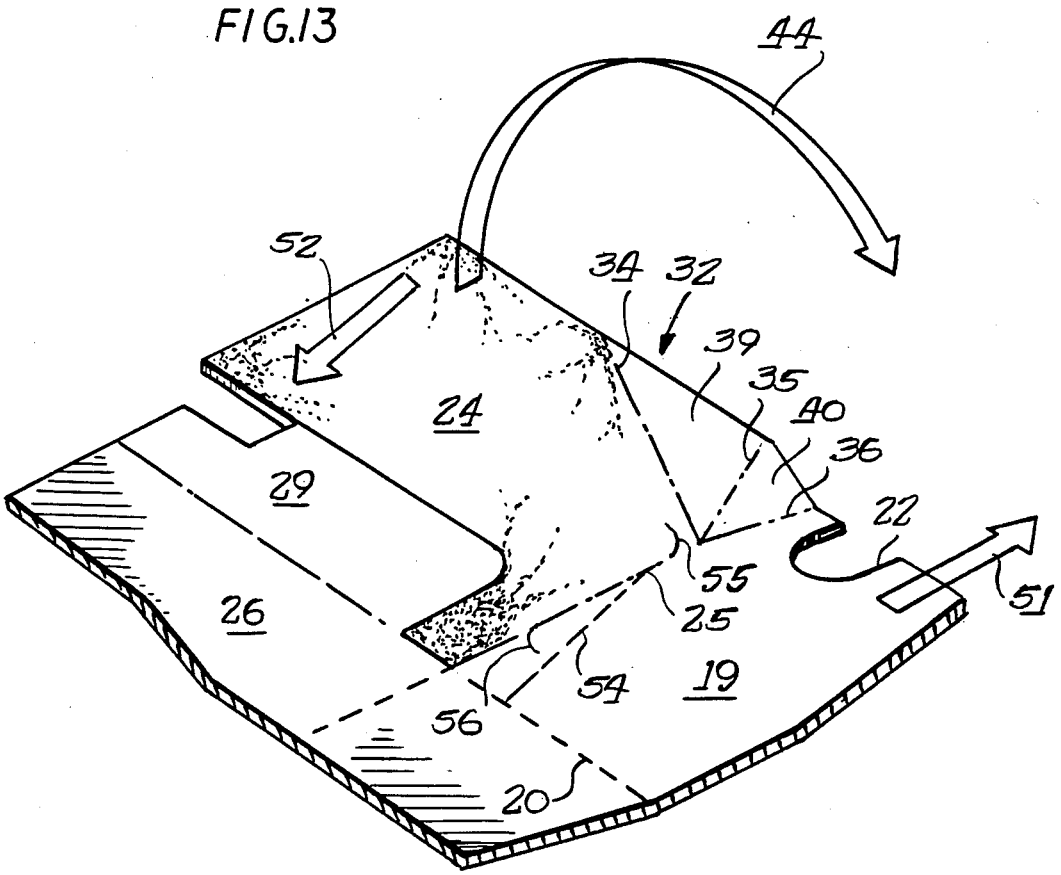
FIG. 13 is an enlarged perspective view showing a portion of the hand-hold forming portion of the blank.

With reference to FIG. 13, an enlarged perspective of a portion of the extension 24 and intermediate end panel 19 is shown. During assembly of the blank 10 into the assembled box of FIG. 10, the blank travels on a conveyor in the direction generally indicated by the arrow 51. A turn bar or the like folds the extension 24 back onto the intermediate end panel 19, as indicated by arrow 44, exerting a drag force on the extension 24 about the scored hinge line 25 as indicated by the arrow 52, which tends to skew the fold line off the hinge line 25 and into the intermediate end panel 19, as indicated by the dotted line 54. (The degree to which the line 54 is skewed from the hinge line 25 is exaggerated for purposes of illustration.)

In order to cause the extension 24 to fold on the hinge line 25, despite the skewing force 52, the hinge line 25 includes relief cuts 55, 56 transverse to the hinge line 25 and extending all the way through the blank 10 at the leading and trailing ends, respectively, of the scored hinge line 25. (The leading end is that end at which the fold is initiated.) The relief cuts 55, 56 are curved or offset from the hinge line 25, with the lead relief cut 55 extending into the panel 24 that is folded by the turn bar, while the trailing relief cut 56 extends into the "unfolded" or stationary panel 19 onto which the panel 24 is folded. The relief cuts 55, 56 provide a path of decreased folding resistance, causing the panel 19 to fold about the hinge line 25 that extends between the relief cuts 55, 56, rather than causing the fold to skew off the hinge line 25. In practice, the relief cuts 55, 56 are less than approximately ¼ inch in length and form a substantially right angle with respect to the hinge line 25. However, this may vary depending upon the stiffness and thickness of the corrugated fiberboard material used for the blank 10.

Referring to FIG. 9, after the extension 24 is folded about the hinge line 25 into contact with the intermediate end panel 14, the side panel 12 is folded about the hinge line 14, as indicated by arrow 45, so as to form a 90° angle with respect to the bottom panel 11. Simultaneously, the combination of the extension 24 and intermediate end panel 19 is folded about hinge line 20 as indicated by arrow 46, so as to form a 90° angle with respect to both the side panel 12 and the bottom panel 11. When the opposite side of the blank is folded in a likewise manner, a complete enclosure is formed, as best seen in FIGS. 3, 4 and 6.

Figure 2:
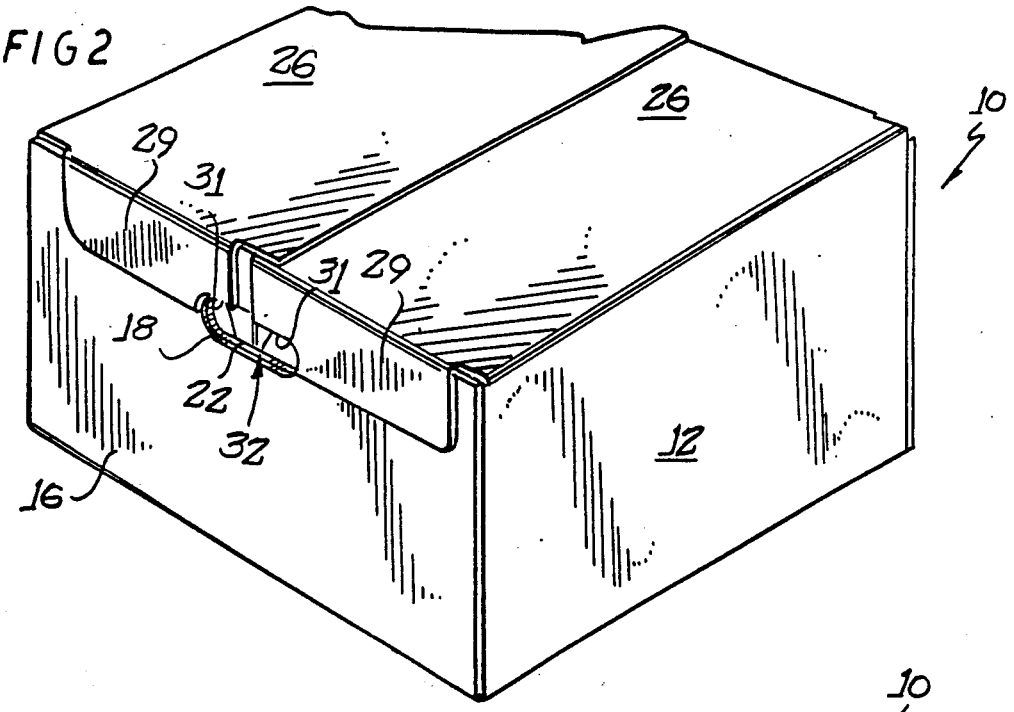
FIG. 2 is a perspective view showing the assembled container.

With reference to FIG. 10, adhesive is applied to the interface of the exterior end panel 16 and intermediate end panel 19, and the outer end panel 16 is folded up 90° about the hinge line 15, as indicated by arrow 48, so as to be secured to the intermediate end panel 19. It should be noted that the hand-hold 18 in the exterior end panel 19 aligns with the cutouts 22 and hand-hold enclosures 32 of the two inner end panels 19, 24. The container is now ready for filling, and after the container is filled, the top panels 26 may be folded about the hinge line 28, as indicated by arrow 49, and the closed container secured by applying adhesive to the glue flaps 29 and folding down about hinge line 30, as indicated by arrow 50, so as to be adhesively secured to the outside of the exterior end panel 16. When so assembled, a container as illustrated in FIG. 2 results.

Thus it can be seen that a triple-end container having self-forming hand-hold enclosures is provided, with the enclosures being limited to the area directly behind the hand-hold slots and the blank being adapted to fold along the desired lines. While the invention has been described in terms of a preferred embodiment, there is no intention to limit the invention to the same, on the contrary it is intended to cover all modifications and equivalents within the scope of the appended claims.

What is claimed is:

1. An improved paperboard blank having a double-ended straight hinge line between two contiguous panels which are folded toward each other along the hinge line, the improvement comprising:
   - a first relief cut at a point on said hinge line remote from a first end threof and extending only into one of the panels at a direction generally transverse to the hinge line;
   - a second relief cut at a point on said hinge line remote from a second end thereof and extending only into the other panel at a direction generally transverse to the hinge line; and
   - a path of decreased folding resistance extending along said hinge line between said first and second relief cuts,
   - whereby folding of said panel is confined to said hinge line and is preventing from diverging to a line skewed therefrom.

2. The blank of claim 1 wherein a portion of one of said relief cuts immediately adjacent the hinge line is curved away from said transverse direction toward the other relief cut.

3. The blank of claim 1 wherein said portion of the hinge line extending between said relief cuts comprises a major portion of the length of said hinge line.

4. The paperboard blank of claim 1 wherein the relief cuts are less than ¼ inch in length extend all the way through the paperboard blank.

5. A method of preparing a paperboard blank having a double-ended straight hinge line between two contiguous panels to ensure that the paperboard is folded on the hinge line without skewing at an angle thereto, comprising the steps of:
   - making a first relief cut at a point on said hinge line remote from a first end thereof, said cut extending only into one of the panels at a direction generally transverse to the hinge line; and
   - making a second relief cut on a point on said hinge line remote from a second end thereof and extending only into the other panel at a direction generally transverse to the hinge line, to form a path of decreased folding resistance along a portion of said hinge line extending between said relief cuts, whereby folding of said panel is confined to said hinge line and is prevented from diverging to a line skewed therefrom.

6. The method of claim 5 wherein a portion of one of said relief cuts immediately adjacent the hinge line is curved from said transverse direction toward the other relief cut.

7. The method of claim 5 wherein said portion of the hinge line extending between said relief cuts comprises a major portion of the length of said hinge line.

8. The method of claim 5 wherein the relief cuts are less than approximately $\frac{1}{4}$ inch in length and extend through the paperboard.

* * * * *